US010634292B1

(12) United States Patent
Xu

(10) Patent No.: US 10,634,292 B1
(45) Date of Patent: Apr. 28, 2020

(54) LED LAMP WITH SHELL AND HOLDER INSERTED THEREIN

(71) Applicants: Yaoping Xu, Changzhou (CN); Changzhou KAISEN Photoelectricity Co. Ltd., Changzhou (CN)

(72) Inventor: Yaoping Xu, Changzhou (CN)

(73) Assignees: CHANGZHOU KAISEN PHOTOELECTRICITY CO., LTD., Changzhou (CN); Yaoping Xu, Changzhou (CN)

( * ) Notice: Subject to any disclaimer, the term of this patent is extended or adjusted under 35 U.S.C. 154(b) by 0 days.

(21) Appl. No.: 16/267,827

(22) Filed: Feb. 5, 2019

(51) Int. Cl.

| | |
|---|---|
| ***F21K 9/275*** | (2016.01) |
| ***F21K 9/272*** | (2016.01) |
| ***F21V 19/00*** | (2006.01) |
| ***F21K 9/68*** | (2016.01) |
| *F21Y 103/10* | (2016.01) |
| *F21Y 115/10* | (2016.01) |

(52) U.S. Cl.
CPC ..... *F21K 9/275* (2016.08); *F21K 9/272* (2016.08); *F21K 9/68* (2016.08); *F21V 19/003* (2013.01); *F21Y 2103/10* (2016.08); *F21Y 2115/10* (2016.08)

(58) Field of Classification Search
CPC ..... F21Y 2115/10; F21K 9/27; F21K 9/272; F21K 9/275; F21K 9/278; F21S 4/25; F21S 4/20; F21V 19/003; F21V 19/0045
See application file for complete search history.

(56) References Cited

U.S. PATENT DOCUMENTS

2007/0047229 A1* 3/2007 Lee ..... F21V 5/04 362/237
2016/0053973 A1* 2/2016 Tress ..... F21S 4/28 362/217.02

* cited by examiner

*Primary Examiner* — Robert J May
(74) *Attorney, Agent, or Firm* — Muncy, Geissler, Olds & Lowe, P.C.

(57) ABSTRACT

An LED lamp includes a shell, a holder, LED strings and a circuit board. The shell includes a top strip and two lateral strips each of which includes a curved section extending from the top strip, a hemi-circular section extending from the curved section, and a straight section extending from the hemi-circular section and including a reflective face. The holder is inserted in the shell and formed with a middle strip and two lateral strips each of which includes an upper section extending above the middle strip and a lower section extending below the middle strip. The lower section of each lateral strip of the holder is inserted in a groove defined by the hemi-circular section of a corresponding lateral strip of the shell. The LED strings are connected to the holder. The circuit board is connected to the holder.

14 Claims, 5 Drawing Sheets

LED LAMP WITH SHELL AND HOLDER INSERTED THEREIN

BACKGROUND OF INVENTION

1. Field of Invention

The present invention relates to an LED lamp and, more particularly, to an LED lamp that can easily be assembled.

2. Related Prior Art

Conventionally, an LED lamp includes an LED assembly inserted in a shell. The LED assembly includes an array of LEDs connected to a circuit board. A proper tool is used to drive screws in the circuit board and the shell to connect the circuit board to the shell. This is however a troublesome process.

The present invention is therefore intended to obviate or at least alleviate the problems encountered in prior art.

SUMMARY OF INVENTION

It is the primary objective of the present invention to provide an LED lamp that can easily be assembled.

To achieve the foregoing objective, the LED lamp includes a shell, a holder, LED strings and a circuit board. The shell includes a top strip and two lateral strips each of which includes a curved section extending from the top strip, a hemi-circular section extending from the curved section, and a straight section extending from the hemi-circular section and including a reflective face. The holder is inserted in the shell and formed with a middle strip and two lateral strips each of which includes an upper section extending above the middle strip and a lower section extending below the middle strip. The lower section of each lateral strip of the holder is inserted in a groove defined by the hemi-circular section of a corresponding lateral strip of the shell. The LED strings are connected to the middle strip of the holder. The circuit board is connected to the upper sections of the lateral strips of the holder.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
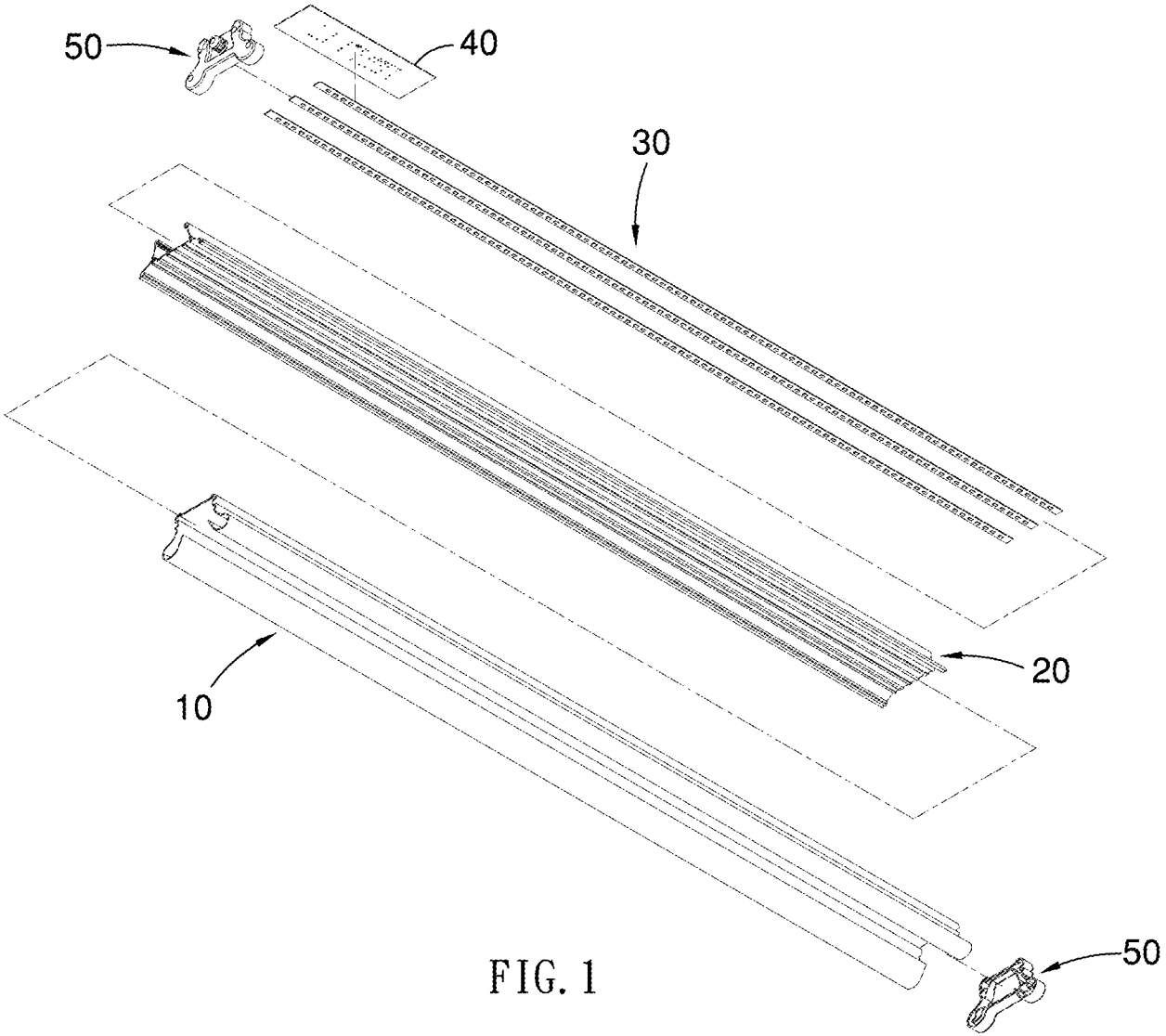
FIG. 1 is a perspective view of an LED lamp according to the preferred embodiment of the present invention.
Figure 2:
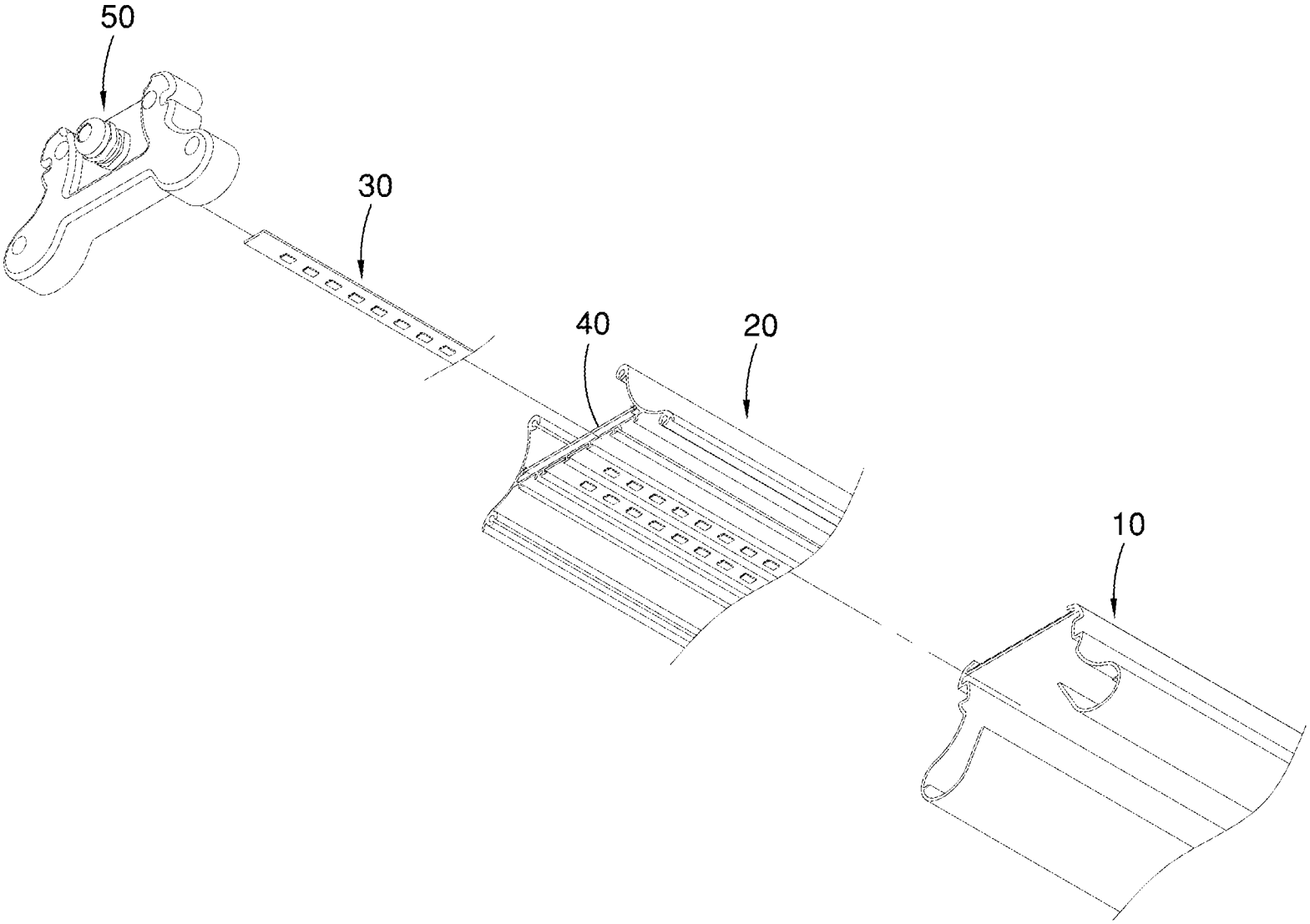
FIG. 2 is an exploded view of the LED lamp shown in FIG. 1.
Figure 3:
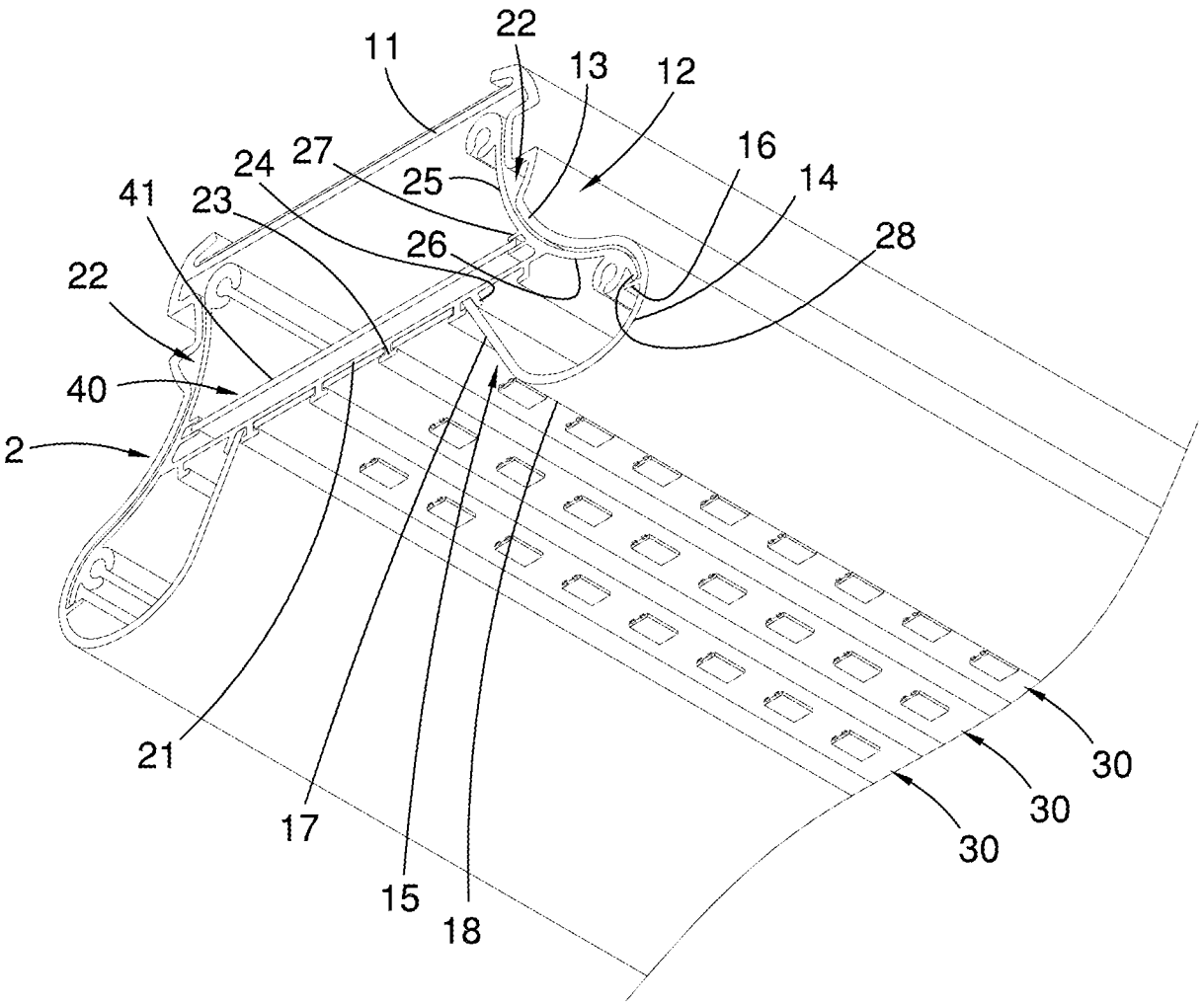
FIG. 3 is an enlarged partial view of the LED lamp shown in FIG. 1.

Referring to FIGS. 1 to 3, an LED lamp includes a shell 10, a holder 20, LED strings 30, a circuit board 40 and two covers 50 according to the preferred embodiment of the present invention. Preferably, the shell 10 and the holder 20 are made by extrusion of aluminum.

The shell 10 includes a top strip 11 formed between two lateral strips 12. Each of the lateral strips 12 includes a curved section 13, a hemi-circular section 14, a straight section 15 and a rib 16. The curved section 13 extends from the top strip 11. The hemi-circular section 14 extends from the curved section 13. The straight section 15 extends from the hemi-circular section 14. The straight section 15 includes a reflective face 17 and an edge 18. The straight section 15 is used as a reflector for including the reflective face 17. The rib 16 extends from an internal face of the hemi-circular section 14. The internal face of the hemi-circular section 14 defines a groove (not numbered).

Preferably, the curved sections 13 of the lateral strips 12 extend from each other as they extend from the top strip 11. The hemi-circular sections 14 of the lateral strips 12 extend toward each other as they extend from the curved sections 13 of the lateral strips 12. The straight sections 15 of the lateral strips 12 extend toward each other as they extend from the hemi-circular sections 14 of the lateral strips 12. The reflective faces 17 of the straight sections 15 of the lateral strips 12 face each other. The ribs 16 of the lateral strips 12 extend toward each other as they extend from the hemi-circular sections 14 of the lateral strips 12.

The holder 20 includes a middle strip 21 formed between two lateral strips 22. The middle strip 21 is formed with four tracks 23 and two fins 24 on a lower face. Each of the tracks 23 is T-shaped when it is view from an end. Each of the lateral strips 22 is shaped corresponding to the curved section 13 of a corresponding one of the lateral strips 12. Each of the lateral strips 22 includes an upper section 25 extending above the middle strip 21 and a lower section 26 extending below the middle strip 21. The upper section 25 includes a clip 27 formed on an internal face. The lower section 26 is formed with an edge 28.

Each of the LED strings 30 includes a series of LEDs 31 attached to and arranged along a strip 32. The strips 32 can be a circuit board for example.

The circuit board 40 is preferably a printed circuit board. The circuit board 40 is formed with two lateral edges 41. The circuit board 40 is electrically connected to the LEDs 31.

Figure 4:
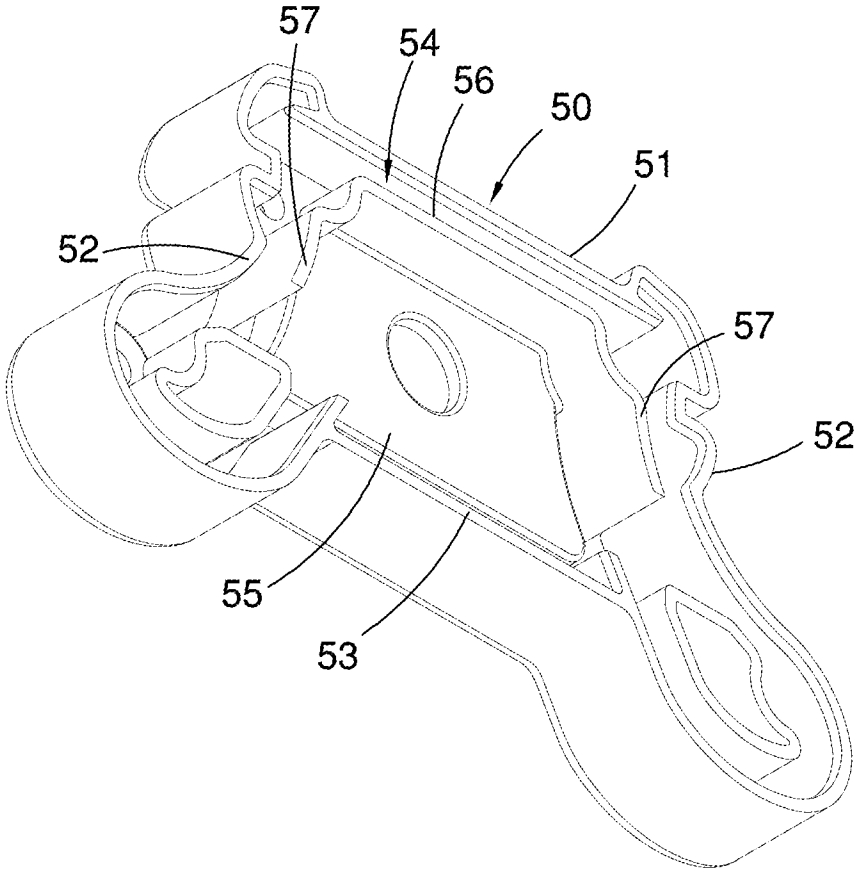
FIG. 4 is an enlarged perspective view of a cover of the LED lamp shown in FIG. 1.

Referring to FIG. 4, each of the covers 50 includes an upper strip 51, two lateral strips 52, a lower strip 53, a supporting element 54 and a panel 55. The upper strip 51, the lateral strips 52, the lower strip 53 and the supporting element 54 extend from an internal face of the panel 55. The upper strip 51 is shaped corresponding to the top strip 11. The lateral strips 52 are shaped corresponding to the lateral strips 12. The supporting element 54 includes a top strip 56 and two lateral strips 57.

Figure 5:
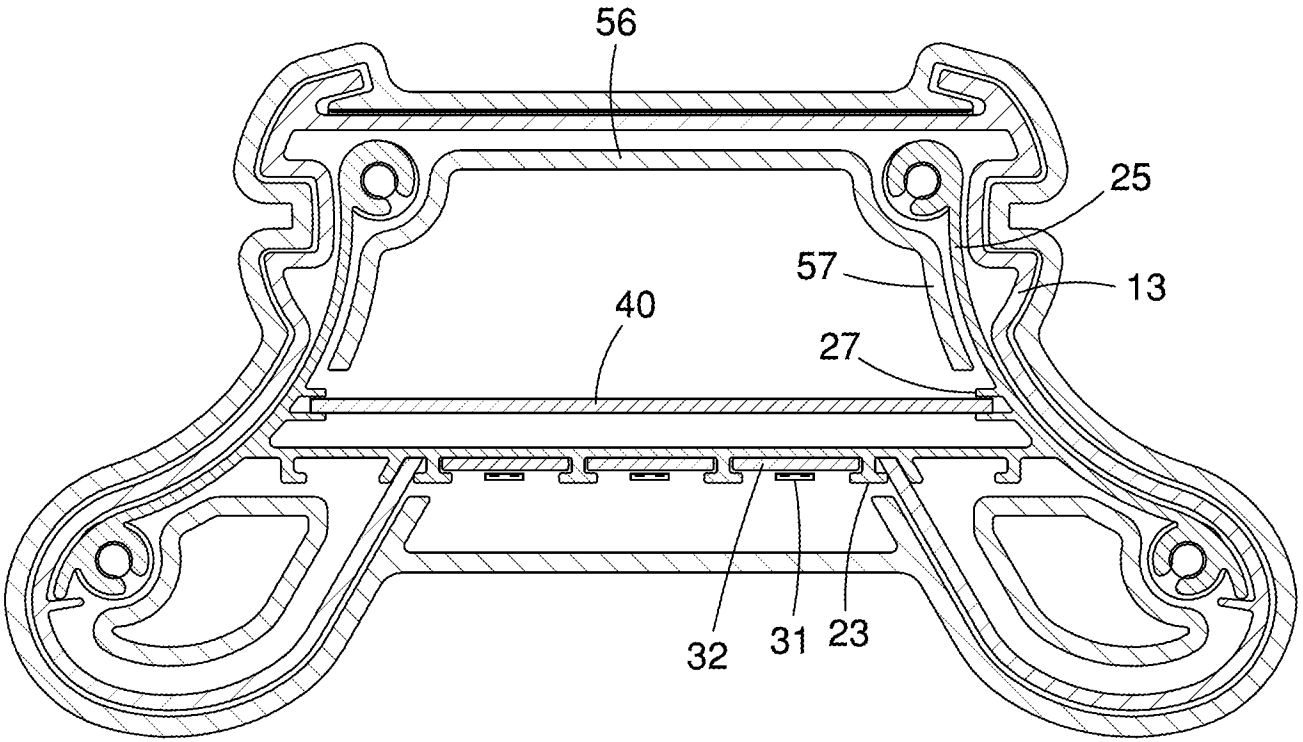
FIG. 5 is an enlarged cross-sectional view of the LED lamp shown in FIG. 1.

Referring to FIG. 5, the holder 20 is inserted in the shell 10. The lower sections 26 of the lateral strips 22 are substantially inserted in the grooves defined by the hemi-circular sections 14 of the lateral strips 12. The lower edges 28 of the lateral strips 22 are supported on the ribs 16 of the lateral strips 12. The edge 18 of each of the lateral strips 12 is inserted in a groove (not numbered) defined between a corresponding one of the fins 24 and a corresponding one of the tracks 23.

Each of the strips 32 is located between and supported by two corresponding ones of the tracks 23.

Each of the lateral edges of the circuit board 40 is clipped by a corresponding one of the clips 27 of the holder 20.

The covers 50 are connected to the shell 10. The upper section 25 of each of the lateral strips 22 is located between a corresponding one of the lateral strips 57 and the curved section 13 of a corresponding one of the lateral strips 12. Thus, the upper section 25 of each of the lateral strips 22 is protected.

The LEDs 31 can be actuated to emit light. Some of the light emitted from the LEDs 31 can be reflected from the reflective faces 17.

The LED lamp can be assembled with bare hands, without having to use any tool. Hence, the assembly of the LED lamp is easy.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. An LED lamp comprising:

a top strip and two lateral strips each of which comprises a curved section extending from the top strip, a hemi-circular section extending from the curved section, and a straight section extending from the hemi-circular section and comprising a reflective face;

a holder inserted in a shell and formed with a middle strip and two additional lateral strips each of which comprises an upper section extending above the middle strip and a lower section extending below the middle strip, wherein the lower section of each of the additional lateral strips of the holder is inserted in a groove defined by the hemi-circular section of a corresponding one of the lateral strips of the shell;

LED strings connected to the middle strip of the holder; and a circuit board connected to the upper sections of the additional lateral strips of the holder.

2. The LED lamp according to claim 1, wherein each of the lateral strips of the shell comprises a rib extending on an internal face of the hemi-circular section, and the lower section of each of the additional lateral strips of the holder comprises an edge supported on the rib of a corresponding one of the lateral strips of the shell.

3. The LED lamp according to claim 1, wherein each of the additional lateral strips of the holder comprises a clip for clipping a lateral edge of the circuit board.

4. The LED lamp according to claim 1, wherein the middle strip of the holder comprises tracks, and each of the LED strings comprises a strip supported on two adjacent ones of the tracks and LEDs connected to the strip.

5. The LED lamp according to claim 4, wherein each of the tracks is T-shaped when it is viewed from a longitudinal end of the each of the tracks.

6. The LED lamp according to claim 4, wherein the middle strip of the holder further comprises two fins, the tracks are located between the fins, and the straight section of each of the lateral strips of the shell comprises an edge inserted in a groove defined between a corresponding one of the fins and a corresponding one of the tracks.

7. The LED lamp according to claim 1, wherein the reflective faces of the straight sections of the lateral strips face each other.

8. The LED lamp according to claim 1, wherein the curved sections of the lateral strips of the shell extend from each other as they extend from the top strip.

9. The LED lamp according to claim 8, wherein the hemi-circular sections of the lateral strips of the shell extend toward each other as they extend from the curved sections of the lateral strips.

10. The LED lamp according to claim 9, wherein the straight sections of the lateral strips extend toward each other as they extend from the hemi-circular sections of the lateral strips of the shell.

11. The LED lamp according to claim 1, further comprising two covers connected to ends of the shell.

12. The LED lamp according to claim 11, wherein each of the covers comprises:

a panel;

an upper strip extending from the panel corresponding to the top strip of the shell; and two lateral strips extending from the panel corresponding to the lateral strips.

13. The LED lamp according to claim 12, wherein each of the covers comprises a supporting element extending from the panel.

14. The LED lamp according to claim 13, wherein the supporting element of each of the covers comprises two lateral strips and a top strip formed between the lateral strips, and the upper section of each of the additional lateral strips of the holder is located between a corresponding one of the lateral strips of each of the covers and the curved section of a corresponding one of the lateral strips of the shell.

* * * * *